US009608367B2

(12) United States Patent
Chen

(10) Patent No.: US 9,608,367 B2
(45) Date of Patent: Mar. 28, 2017

(54) APPARATUS PROVIDING ONE OR MORE SOCKET CONTACTS FOR CONTACTING AN INSERTED FLEXIBLE, PLANAR CONNECTOR; A METHOD

(71) Applicant: Nokia Technologies Oy, Espoo (FI)

(72) Inventor: Chong Chen, Beijing (CN)

(73) Assignee: Nokia Technologies Oy, Espoo (FI)

( * ) Notice: Subject to any disclaimer, the term of this patent is extended or adjusted under 35 U.S.C. 154(b) by 0 days.

(21) Appl. No.: 14/650,715

(22) PCT Filed: Dec. 11, 2012

(86) PCT No.: PCT/CN2012/086382

§ 371 (c)(1),
(2) Date: Jun. 9, 2015

(87) PCT Pub. No.: WO2014/089761

PCT Pub. Date: Jun. 19, 2014

(65) Prior Publication Data

US 2015/0311625 A1 Oct. 29, 2015

(51) Int. Cl.
*H01R 12/00* (2006.01)
*H01R 13/629* (2006.01)
*H01R 12/77* (2011.01)

(52) U.S. Cl.
CPC ..... *H01R 13/629* (2013.01); *H01R 12/774* (2013.01); *H01R 12/778* (2013.01)

(58) Field of Classification Search
CPC ..... H01R 12/62; H01R 12/79; H01R 23/668; H05K 3/365; H05K 3/361
USPC ..... 439/67, 77, 600, 660, 636, 637
See application file for complete search history.

(56) References Cited

U.S. PATENT DOCUMENTS 3,245,024 A * 4/1966 Evans ..... H01R 13/113 439/344
3,522,484 A * 8/1970 Clements ..... H01R 12/79 361/756
4,379,608 A * 4/1983 Olsson ..... H01R 12/62 439/329
4,416,497 A * 11/1983 Brandsness ..... H01R 12/774 439/492

(Continued)

FOREIGN PATENT DOCUMENTS

CN 1883083 A 12/2006
CN 201038382 Y 3/2008
JP 2007-3111122 A 11/2007

OTHER PUBLICATIONS

Molex FFC-FPC Connectors and Jumpers, www.molex.com/moels/products, Nov. 27, 2012, 2 pgs.

(Continued)

*Primary Examiner* — Abdullah Riyami
*Assistant Examiner* — Vladimir Imas
(74) *Attorney, Agent, or Firm* — Harrington & Smith

(57) ABSTRACT

An apparatus including a housing: including an upper surface and a socket cavity, the socket cavity extending underneath the upper surface, from an opening at the upper surface, to provide one or more socket contacts; and at least one retainer, within the socket cavity, configured to be automatically actuated to retain a flexible planar connector including connector contacts, for contacting the socket contacts underneath the upper surface, inserted along the socket cavity.

19 Claims, 3 Drawing Sheets

(56) References Cited

U.S. PATENT DOCUMENTS 4,634,195 A * 1/1987 Shoemaker ..... H01R 12/79 439/493
4,640,562 A * 2/1987 Shoemaker ..... H01R 12/79 439/327
4,740,867 A * 4/1988 Roberts ..... H01R 12/79 361/749
4,778,403 A * 10/1988 Ikesugi ..... H01R 12/79 439/329
4,824,391 A * 4/1989 Ii ..... H01R 12/61 439/329
4,948,379 A * 8/1990 Evans ..... H01R 12/79 439/329
4,993,958 A * 2/1991 Trobough ..... H01R 12/62 439/67
5,181,854 A * 1/1993 Masuda ..... H01R 12/7082 439/493
5,201,661 A * 4/1993 Ii ..... H01R 12/58 439/260
5,213,534 A * 5/1993 Gardner ..... H01R 12/592 439/495
5,219,293 A * 6/1993 Imamura ..... H01R 12/62 439/493
5,354,214 A * 10/1994 Aso ..... H01R 12/79 439/492
5,370,552 A * 12/1994 Chishima ..... H01R 12/79 439/495
5,383,787 A * 1/1995 Switky ..... H01L 23/32 439/67
5,387,112 A * 2/1995 Chishima ..... H01R 43/16 439/493
5,441,419 A * 8/1995 Takazawa ..... H01R 13/2414 439/67
5,470,246 A * 11/1995 Mosquera ..... H01R 12/79 439/260
5,498,169 A * 3/1996 Ikemoto ..... H01R 12/89 439/260
5,501,610 A * 3/1996 Ikemoto ..... H01R 12/613 439/260
5,514,008 A * 5/1996 Kocher ..... H01R 12/79 439/495
5,623,293 A * 4/1997 Aoki ..... B41J 25/34 347/56
5,767,623 A * 6/1998 Friedman ..... H01R 12/62 174/261
5,772,459 A * 6/1998 Swart ..... H01R 13/193 439/341
5,779,498 A * 7/1998 Asakawa ..... H01R 12/79 439/495
5,803,752 A * 9/1998 McHugh ..... H01R 12/79 439/495
5,882,223 A * 3/1999 Igarashi ..... H01R 12/775 439/260
5,895,287 A * 4/1999 Seto ..... H01R 12/88 439/260
6,036,502 A * 3/2000 Neidich ..... H01R 12/62 439/67
6,097,605 A * 8/2000 Klatt ..... G06F 1/183 361/737
6,283,298 B1 * 9/2001 Seidler ..... A45C 13/008 206/581
6,379,191 B1 * 4/2002 Goetz ..... H01R 13/20 439/660
6,402,558 B1 * 6/2002 Hung-Ju ..... G06K 7/0021 439/638
6,447,305 B1 * 9/2002 Roberts ..... H01R 12/774 439/260
6,536,872 B2 * 3/2003 Goin ..... B41J 2/1752 347/50
6,561,843 B1 * 5/2003 Ma ..... H01R 12/87 439/326
6,581,830 B1 * 6/2003 Jelinek ..... G06K 7/0034 235/439
6,786,762 B2 * 9/2004 Buck ..... H01R 12/62 439/493
6,859,369 B2 * 2/2005 Mambakkam ..... G06F 13/38 235/492
6,966,784 B2 * 11/2005 Van Schuylenbergh ..... H01R 12/78 361/261
7,029,320 B2 * 4/2006 Maejima ..... H01R 12/79 439/329
7,095,618 B1 * 8/2006 Mambakkam ..... G06F 13/38 235/492
7,182,629 B2 * 2/2007 Zhang ..... H01R 12/774 439/495
7,241,166 B2 * 7/2007 Inui ..... H05K 1/117 439/329
7,275,955 B2 * 10/2007 Ko ..... H01R 12/61 439/498
7,354,300 B2 * 4/2008 Shindo ..... H01R 13/648 439/497
7,374,451 B2 * 5/2008 Wei ..... H01R 12/774 439/494
7,399,192 B2 * 7/2008 Yamamoto ..... H01R 12/79 439/260
7,625,231 B2 * 12/2009 Takahira ..... H01R 12/79 439/260
7,789,699 B2 * 9/2010 Wang ..... H01R 12/592 439/495
7,817,111 B2 * 10/2010 Park ..... H01R 12/79 345/60
7,878,862 B2 * 2/2011 Shi ..... G06F 21/78 439/131
8,079,861 B2 * 12/2011 Suzuki ..... H01R 12/61 439/260
8,128,425 B2 * 3/2012 Takahashi ..... H01R 12/79 439/260
8,133,067 B2 * 3/2012 Tsai ..... H01R 12/79 439/260
8,758,030 B2 * 6/2014 Chen ..... H01R 12/77 439/493
8,888,501 B2 * 11/2014 Hirata ..... H01R 12/716 439/60
8,932,083 B2 * 1/2015 Ho ..... H01R 12/613 439/660
9,249,587 B2 * 2/2016 Hunt ..... E02D 27/013
2004/0023551 A1 2/2004 Suzuki et al. ..... 439/495
2005/0118861 A1 * 6/2005 Chung ..... H01R 12/62 439/495
2006/0030206 A1 * 2/2006 Zhang ..... H01R 12/774 439/495
2007/0054529 A1 3/2007 Harlan et al. ..... 439/260
2007/0111602 A1 5/2007 Suzuki ..... 439/20.26
2007/0141897 A1 * 6/2007 Miura ..... H01R 12/88 439/495
2008/0003858 A1 1/2008 Little et al. ..... 439/260

OTHER PUBLICATIONS

Molex FFC/FPC (SMT) Connectors, www.molex.com/molex/products/family, Nov. 27, 2012, 2 pgs.
Molex LVDA FFC Connectors, www.molex.com/molex/products/family, Nov. 27, 2012, 1 pg.
Molex FFC-FPC (Through Hole), www.molex.com/molex/products/family, Nov. 27, 2012, 1 pg.

* cited by examiner

APPARATUS PROVIDING ONE OR MORE SOCKET CONTACTS FOR CONTACTING AN INSERTED FLEXIBLE, PLANAR CONNECTOR; A METHOD

TECHNOLOGICAL FIELD

Embodiments of the present invention relate to an apparatus providing one or more socket contacts for contacting an inserted flexible, planar connector; a method.

BACKGROUND

It may be desirable to easily electrically interconnect two components but less easily disconnect the two components.

If one of the components is a flexible planar connector, such as for example a flexible circuit board, then it may be push-fitted into a surface-mounted socket comprising socket contacts.

BRIEF SUMMARY

According to various, but not necessarily all, embodiments of the invention there is provided an apparatus comprising: a housing comprising: an upper surface and a socket cavity, the socket cavity extending underneath the upper surface, from an opening at the upper surface, to provide one or more socket contacts; and at least one retainer, within the socket cavity, configured to be automatically actuated to retain a flexible planar connector comprising connector contacts, for contacting the socket contacts underneath the upper surface, inserted along the socket cavity.

According to various, but not necessarily all, embodiments of the invention there is provided a method comprising: providing a socket cavity at least partially underneath a surface, wherein the socket cavity has an opening at the surface; providing electrical connection to one or more socket contacts in the socket cavity; and automatically controlling a curved path of a flexible planar connector from the opening, through the socket cavity, by providing resilient structures that guide and retain the flexible planar connector.

BRIEF DESCRIPTION

For a better understanding of various examples of embodiments of the present invention reference will now be made by way of example only to the accompanying drawings in which.

DETAILED DESCRIPTION

Figure 1:
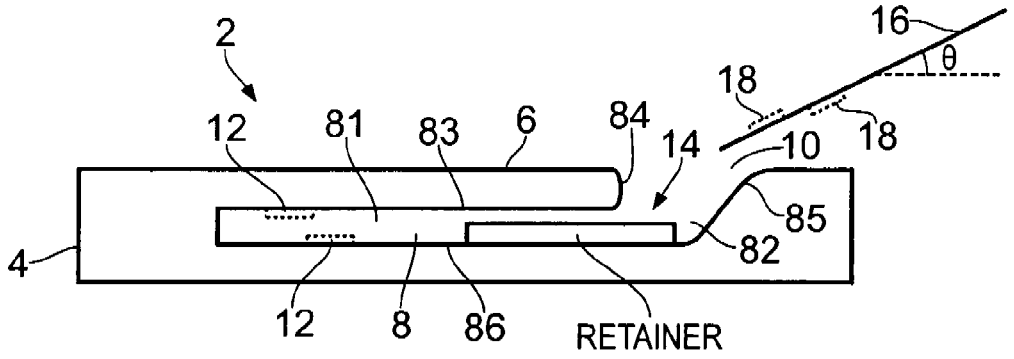
FIG. 1 illustrates an example of an apparatus operable as a low-profile or sunken socket for a flexible planar connector.

The Figures illustrate an apparatus 2 comprising: a housing 4 comprising an upper surface 6 and a socket cavity 8, the socket cavity 8 extending underneath the upper surface 6, from an opening 10 at the upper surface 6, to provide one or more socket contacts 12; and at least one retainer 14, within the socket cavity 8, configured to be automatically actuated to retain a flexible planar connector 16 comprising connector contacts 18, for contacting the socket contacts 12 underneath the upper surface 6, inserted along the socket cavity 8.

FIG. 1 illustrates an example of an apparatus 2 that operates as a low-profile or sunken socket for a flexible planar connector 16.

The apparatus 2 is configured to enable physical and electrical contact between socket contacts 12 housed within a sunken socket cavity 8 and connector contacts 18 of the flexible planar connector 16.

In some but not necessarily all examples, the flexible planar connector 16 is a flexible circuit board.

The apparatus 2 comprises a housing 4. The housing 4 defines an internal socket cavity 8 that receives the flexible planar connector 8.

The socket cavity 8 is 'sunken'. At least a part of the socket cavity 8, the connector cavity 81, extends underneath an upper surface 6 of the housing 4. The connector cavity 81 comprises one or more socket contacts 12. In this example the connector cavity 81 extends parallel to the upper surface 6.

The upper surface 6 comprises an opening 10 to the socket cavity 8. An intermediate cavity 82 is configured to route the flexible planar connector 16 from the opening 10 to the connector cavity 81.

The socket cavity 8 and opening 10 are configured to facilitate insertion of the flexible planar connector 16 into the intermediate cavity 82 through the opening 10 at an acute angle to the upper surface 6, for example, at an angle of less than 60 degrees.

In the illustrated example, the opening 10 comprises a curved edge 83 configured to facilitate insertion of the flexible planar connector 16 into the cavity through the opening 10.

Also in the illustrated example, a roof portion 83 of the connector cavity 81 curves through the intermediate cavity 82 to form a first side 84 of the opening 10. A second side 85 of the opening 10 opposing the first side of the opening 10 curves in an opposite sense to the curve of the roof portion 83.

A cross-sectional area of the socket cavity 8 decreases from the opening 10 to the connector cavity. For example, the cross-sectional area of the opening 10 in a plane parallel to the upper surface (normal to a first direction) is greater than a cross-sectional area of the connector cavity in a plane normal to a second direction orthogonal to the first direction and running through the connector cavity 81.

The connector cavity 81 is configured to enable a friction fit of the flexible planar connector 16, against the socket contacts 12, in the connector cavity 8. The socket contacts 12 may be associated with the roof 83 of the connector cavity 81 and/or with a floor 86 of the connector cavity.

The apparatus 2 comprise at least one retainer 14, within the socket cavity 8.

The retainer 14 is configured to be automatically actuated to retain the flexible planar connector 16 when it is inserted along the socket cavity 8.

The retainer 14 opposes removal of the inserted flexible planar connector 16 from the socket cavity 8 and therefore facilitates maintenance of physical and electrical contact between socket contacts 12 housed within the socket cavity 8 and connector contacts 18 of the flexible planar connector 16.

Referring to FIG. 1, the apparatus 2 is configured to have a first configuration when the flexible, planar connector 16 comprising contacts is not inserted, in which the at least one retainer 14 is not actuated.

Figure 2:
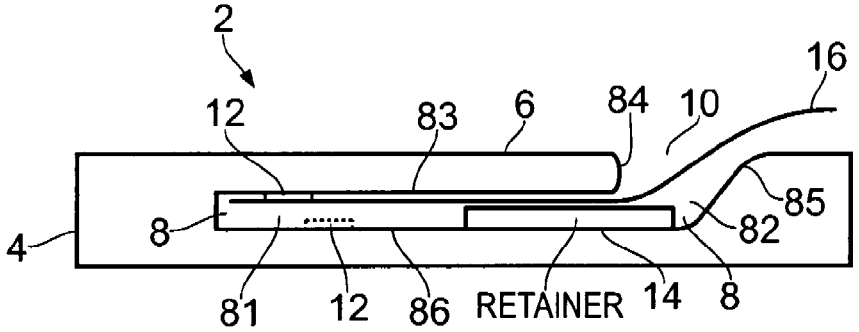
FIG. 2 illustrates an example of an apparatus operating as a low-profile or sunken socket for a flexible planar connector.

Referring to FIG. 2, the apparatus 2 is configured to have a second configuration when the flexible, planar connector 16 is inserted along the socket cavity 8 to make contact between the connector contacts 18 and the socket contacts, in which the at least one retainer 14 is actuated and retains the flexible, planar connector 16.

The retainer 14 may retain the flexible planar connector 16 using one or more friction fits. Examples of friction fits are illustrated in FIGS. 3 and 4.

Figure 3:
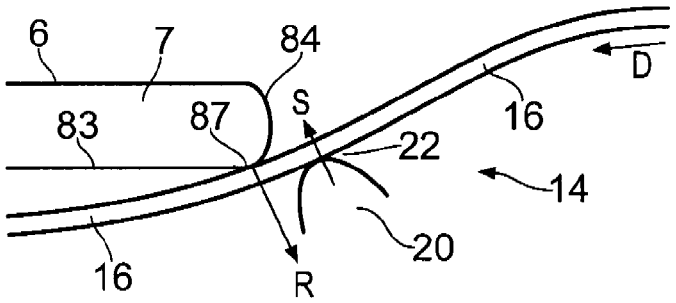
FIG. 3 illustrates an example of a retainer for retaining a flexible planar connector in the apparatus.
Figure 4:
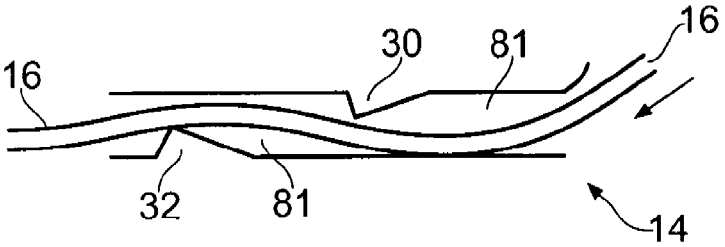
FIG. 4 illustrates another example of a retainer for retaining a flexible planar connector in the apparatus.

Referring to FIG. 3, the housing 4 comprises an overhanging portion 7. Its upper side provides the upper surface 6 and its lower side provides the wall 83 of the socket cavity 8. The overhang portion 7 terminates at the opening 10.

A retainer 14, within the socket cavity 8, is provided by one or more resiliently biased supports 20. The resiliently biased support 20 is biased to press an inserted flexible planar connector 16 against an abutment portion 87 of the overhang portion 7.

The overhang portion 7 is configured such that a reactive force R provided to the inserted flexible planar connector 16 by the abutment portion 87 is off-set, in a direction-of-insertion D of the flexible planar connector 16, from a supporting force S provided to the inserted flexible planar connector 16 by the resiliently biased support 20. This creates a torque which pinches the flexible planar connector 16 and which may also bend the flexible planar connector 16. The resiliently biased support 20 consequently defines a curved path for the flexible planar connector 16 through the socket cavity 8 to the socket contacts 12.

Referring to FIG. 4, a retainer 14 is provided within the connector cavity 81. The retainer 14 comprises a downwardly extending guiding ramp 30 configured to force the flexible planar connector 16 down (away from the roof 83 of the connector cavity 81) and an upwardly extending guiding ramp 32 configured to force the flexible planar connector 16 up (towards the roof 83 of the connector cavity 81).

The upwardly extending guiding ramp 32 is aligned with the downwardly extending guiding ramp 30 along the direction-of-insertion D of the flexible planar connector 16, but is off-set, in the direction D, from the downwardly extending ramp 30. The upwardly extending guiding ramp 32 follows after the aligned downwardly extending guiding ramp 30 in insertion direction D.

The retainer 14 retains the flexible planar connector 16 using a plurality of friction fits between the guiding ramps 30, 32 and the flexible planar connector 16.

One or more of the guiding ramps may be part of one or more socket contacts 12.

A reactive force provided to the inserted flexible planar connector 16 by the downwardly extending guiding ramp 30 is off-set, in the direction D, from a supporting force provided to the inserted flexible planar connector 16 by the upwardly extending guiding ramp 32. This creates a torque which pinches the flexible planar connector 16 and which may also bend the flexible planar connector 16. The guiding ramps 30, 32 therefore define a curved path for the flexible planar connector 16.

Figure 5A:
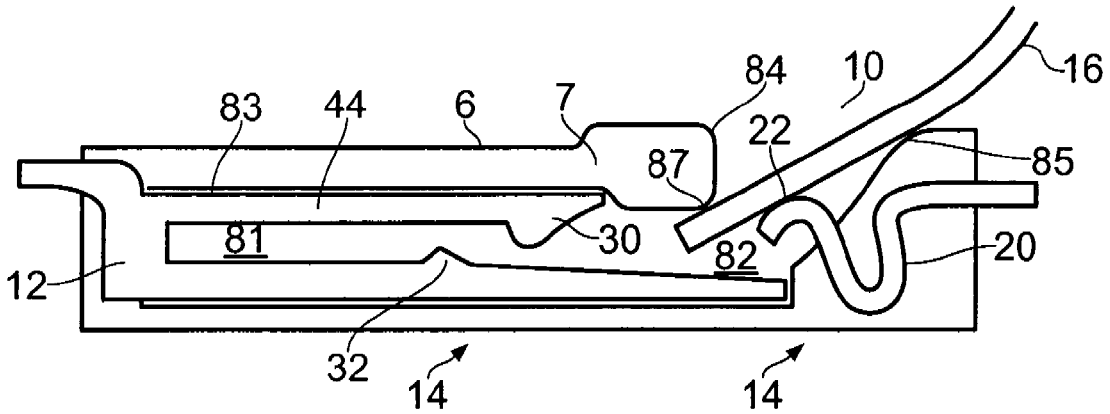
FIGS. 5A, 5B, 5C illustrates (during insertion, after insertion and during removal of the flexible planar connector) an example of an apparatus that operates as a low-profile or sunken socket for a flexible planar connector.

FIG. 5A illustrates an apparatus 2 similar to that described previously in relation to FIGS. 1 and 2 and similar references refer to similar features. The apparatus 2 comprises a retainer 14 described with reference to FIG. 3 and also a retainer 14 described with reference to FIG. 4 and similar references refer to similar features.

Figure 5B:
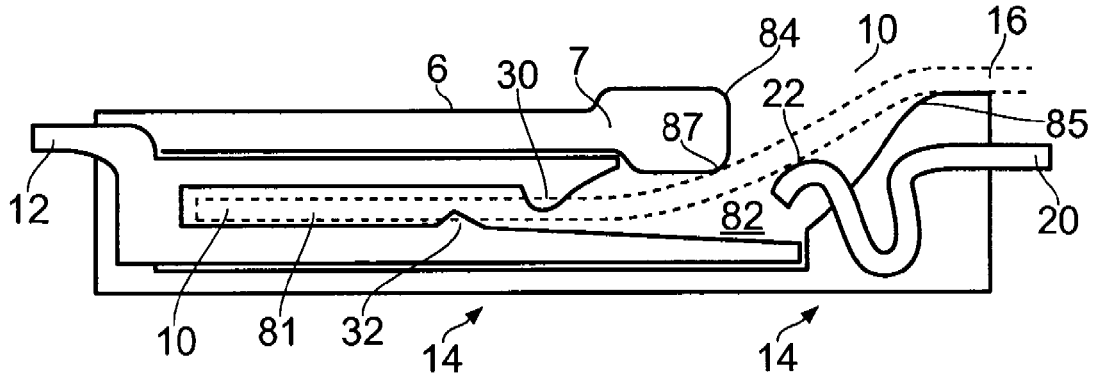
Figure 5C:
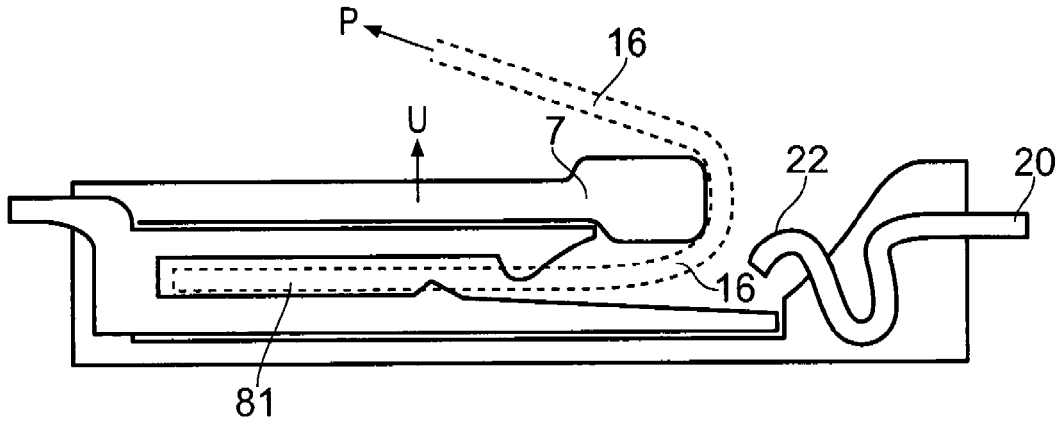
Figure 6A:
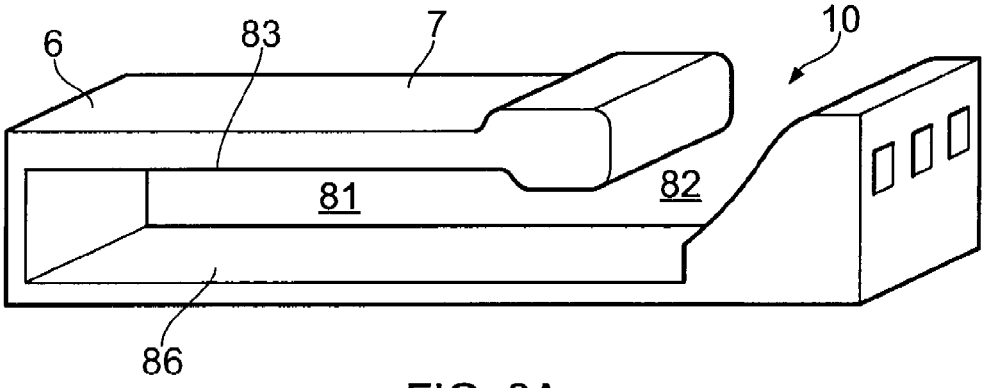
FIG. 6A illustrates the housing of the apparatus illustrated in FIGS. 5A, 5B and 5C.

The housing 4 illustrated in cross-section in FIGS. 5A, 5B and 5C is illustrated in perspective and cross-section in FIG. 6A.

Figure 6B:
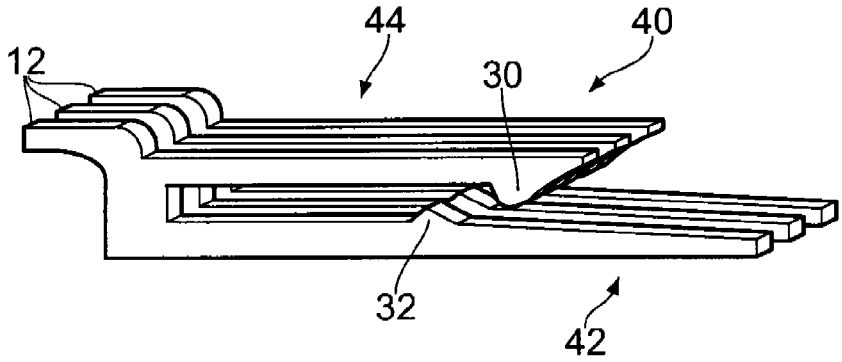
FIG. 6B illustrates a contact arrangement of the apparatus illustrated in FIGS. 5A, 5B and 5C.

The housing 4 receives a contact arrangement 40, illustrated in FIG. 6B, which comprises a plurality of separate contacts 12 within the connector cavity 81. Each of the contacts 12 of the contact arrangement is similar.

Each contact 12 separates into a lower contact 42 and an opposing upper contact 44. When placed within the housing 4, each upper contacts 44 extends along a length of the connector cavity 81 in contact with the roof 83 and each lower contact 42 extends along the length of the connector cavity 81 in contact with the floor 86. The separate contacts 12 are arranged in parallel and are stacked, with separation between them, across the width of the connector cavity 81.

Each of the separate contacts 12 is formed from a unitary piece of metal.

In use, the upper contact 44 and the opposing lower contact 42 of a contact 12 pinch an inserted flexible planar connector 16 and one or both contact the connector contacts 18 of the flexible planar connector 16.

The upper contact 44 comprises the upper guiding ramp 30 which contacts a connector contact 18. The lower contact 44 comprises the lower guiding ramp 32 which contacts a connector contact 18. The co-operation of the guiding ramps 30, 32 has been previously described with reference to FIG. 4.

It will therefore be appreciated that each socket contact 12 comprises a pair of off-set upwardly extending and downwardly extending guiding ramps 30, 32.

The upper guiding ramp 32 forms part of a cantilevered upper contact 44. The cantilever provides a resilient bias that resists upward movement of the upper contact 44.

The lower guiding ramp 30 forms part of a cantilevered lower contact 42. The cantilever provides a resilient bias that resists downward movement of the lower contact 42.

FIG. 5A illustrates the apparatus 2 when a flexible planar connector 16 is being inserted.

FIG. 5B illustrates, using dotted lines, where a flexible planar connector 16 would lie after insertion.

The cantilevers resiliently bias the socket contacts 12 against the inserted flexible planar connector 16. The socket contacts 12 are resiliently deflected when the flexible planar connector 16 is inserted past the pinch point formed by the guiding ramps 30, 32. The flexible planar connector will also flex at this pinch point.

The resilient support 20 biases the surface 22 against the inserted flexible planar connector 16. The resilient support 20 is resiliently deflected when the flexible planar connector 16 is inserted past the pinch point formed by the support 20 and the abutment portion 87 of the overhang portion 7. The flexible planar connector 16 will also flex at this pinch point.

FIG. 5C illustrates how a flexible planar connector 16 may be removed from the apparatus 2 after it has been inserted.

The overhang portion 7 of the housing 4 is deflected upwards. As a consequence, the cantilevered upper contact 44 can then upwardly flex to release the flexible planar connector 16. As another consequence, the abutment surface 85 of the overhang portion 7 is also removed away from the support 20 releasing the flexible planar connector 16.

The overhang portion 7 of the housing 4 may be deflected upwards by bending the flexible planar connector back so that it overlies the connecting cavity 81. In this position, applying a force P by pulling the flexible planar connector results in an upward force U being applied to the overhang portion. This results in upward deflection of the overhang portion 7. The overhang portion 7 of the housing resiliently flexes.

Figure 7:
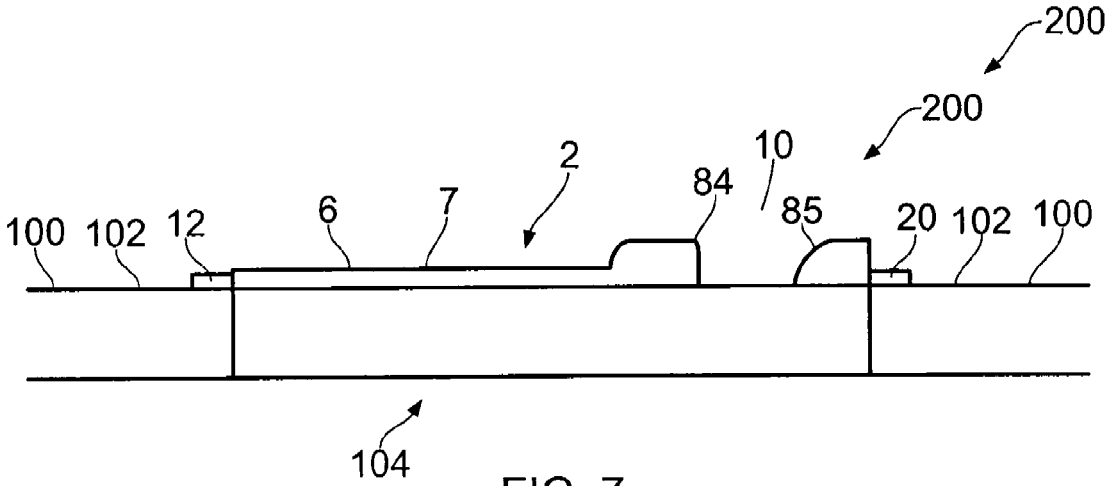
FIG. 7 illustrates an example of an apparatus sunken within a substrate.

FIG. 7 illustrates how the apparatus 2 may be mounted within a substrate 100 of an electronic device 200 to provide a low-profile sunken socket. The substrate 100 may, for example, be a printed wiring board (PWB).

The substrate 100 has an upper surface 102 and a cut-out aperture 104. The apparatus 2 is positioned within the cut-out portion 104 so that the upper surface 6 of the apparatus 2 is substantially level or slightly raised (e.g. 0.2 mm) with respect to the upper surface of the substrate 100.

The first side 84 and the second side 85 of the opening 10 may be slightly raised (e.g. 0.4 mm) above the upper surface 102 of the substrate 100.

The contacts 12 are accessible at the surface 102 of the substrate 100 at one end of the apparatus 2. They may provide supports at that end for positioning the apparatus 2 in the aperture 104.

The biased supports 20 may extend out of the apparatus 2 via apertures at the other end. The biased supports 20 may provide supports at that other end for positioning the apparatus 2 in the aperture 104.

The apparatus 2 therefore provides a socket cavity 8 at least partially underneath a surface 6. The socket cavity 8 has an opening 10 at the surface 6. It also provides electrical connection(s) to one or more socket contacts 12 in the socket cavity 8. The apparatus 2 is configured to automatically control a curved path of a flexible planar connector 16 from the opening 10, through the socket cavity 8, by providing resilient structures 20, 30 that guide and retain the flexible planar connector 16.

The apparatus 2 may have a number of advantages including none, one or more of the following:

it may be easier to insert a flexible planar connector 16 it may be easy to insert a flexible planar connector 16 in a single action it may be difficult to remove the flexible planar connector 16 accidentally The apparatus 2 may provide a low insertion force (LIF) flexible printed circuit (FPC) connector socket. The connector socket may be sunken into a substrate 1001 (e.g. a printed wiring board (PWB)) of a device 200.

Although embodiments of the present invention have been described in the preceding paragraphs with reference to various examples, it should be appreciated that modifications to the examples given can be made without departing from the scope of the invention as claimed.

Features described in the preceding description may be used in combinations other than the combinations explicitly described.

Although functions have been described with reference to certain features, those functions may be performable by other features whether described or not.

Although features have been described with reference to certain embodiments, those features may also be present in other embodiments whether described or not.

Whilst endeavoring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

What is claimed is:

1. An apparatus comprising:

a housing comprising: an upper surface and a socket cavity, the socket cavity extending underneath the upper surface, from an opening at the upper surface, to provide one or more socket contacts;

at least one retainer configured to resiliently deflect from a first position;

wherein the apparatus is configured for insertion of a flexible planar connector into the socket cavity;

wherein the apparatus is configured to have a first configuration in which the at least one retainer is at the first position, when the flexible planar connector is not inserted into the socket cavity;

wherein the apparatus is configured to have automatically a second configuration in which the at least one retainer is resiliently deflected from the first position to a second position in response to the flexible planar connector being inserted into the socket cavity; and wherein the apparatus is configured to have a third configuration different to the second configuration in which the at least one retainer is at or has partially returned to the first position from the second position, after the flexible planar connector has been inserted into the socket cavity.

2. An apparatus as claimed in claim 1, wherein the flexible, planar connector comprises connector contacts; and wherein the at least one retainer is actuated and retains the flexible, planar connector when the flexible, planar connector is inserted along the socket cavity to make contact between the connector contacts and the socket contacts.

3. An apparatus as claimed in claim 2, wherein the socket cavity and opening are configured to facilitate insertion of the flexible planar connector into the cavity through the opening at an angle of attack relative to the upper surface that is less than 60 degrees.

4. An apparatus as claimed in claim 3, wherein the opening comprises a curved edge configured to facilitate insertion of the flexible planar connector into the cavity through the opening at an acute angle to the upper surface.

5. An apparatus as claimed in claim 1, wherein the socket cavity comprises a connector cavity, underneath the upper surface, comprising the socket contacts and an intermediate cavity for routing the flexible planar connector from the opening to the connector cavity.

6. An apparatus as claimed in claim 5, wherein the connector cavity extends parallel to the upper surface.

7. An apparatus as claimed in claim 5, wherein a cross-sectional area of the socket cavity decreases from the opening to the connector cavity.

8. An apparatus as claimed in claim 5, wherein a cross-sectional area of the opening in a plane normal to a first direction is greater than a cross-sectional area of the connector cavity in a plane normal to a second direction wherein the first direction and second direction are orthogonal.

9. An apparatus as claimed in claim 5, wherein the connector cavity is configured to enable a friction fit of the flexible planar connector, against the socket contacts, in the connector cavity.

10. An apparatus as claimed in claim 9, wherein a roof portion of the connector cavity curves through the intermediate cavity to form a first side of the opening.

11. An apparatus as claimed in claim 10, wherein a second side of the opening opposing the first side of the opening curves in an opposite sense to the curve of the roof portion.

12. An apparatus as claimed in claim 1, wherein the at least one retainer retains the flexible planar connector using a plurality of friction fits.

13. An apparatus as claimed in claim 1, wherein the at least one retainer, within the socket cavity, comprises at least one resiliently biased support that is biased to press an inserted flexible planar connector against an abutment portion of a wall defining the socket cavity;

wherein the housing comprises an overhanging portion comprising an upper side defining the upper surface and a lower side defining a wall of the socket cavity, wherein the overhang portion terminates at the opening and wherein the overhang portion provides the abutment portion of the wall against which the inserted flexible planar connector is pressed by the at least one resiliently biased support;

wherein the overhang portion is configured such that a reactive force provided to the inserted flexible planar connector by the abutment portion is off-set, in a direction of insertion of the flexible planar connector, from a supporting force provided to the inserted flexible planar connector by the at least one resiliently biased support.

14. An apparatus as claimed in claim 13, wherein the at least one resiliently biased support defines a curved path for the flexible planar connector through the socket cavity to the socket contacts.

15. An apparatus as claimed in claim 1, wherein the socket contacts comprise an upper portion and an opposing lower portion that pinch an inserted flexible planar connector wherein the upper portion comprises an upper ramp and the opposing lower portion comprises a lower ramp.

16. An apparatus as claimed in claim 1, wherein the socket cavity extending underneath the upper surface comprises at least a downwardly extending guiding ramp configured to force the flexible planar connector down and comprises at least an upwardly extending guiding ramp configured to force the flexible planar connector up, wherein the upwardly extending guiding ramp is aligned with but off-set, in a direction of insertion of the flexible planar connector, from the downwardly extending ramp, wherein the upwardly extending guiding ramp follows after the aligned downwardly extending ramp.

17. An apparatus as claimed in claim 16, wherein each socket contact comprises a pair of off-set upwardly extending and downwardly extending guiding ramps.

18. An electronic device comprising a substrate that has, in an upper surface, an aperture positioning an apparatus as claimed in claim 1, wherein the substrate is a printed wiring board, and wherein the apparatus is positioned in the aperture using a contact arrangement at one end and biased supports at the other end.

19. A method comprising:

providing, in an apparatus, a socket cavity at least partially underneath a surface, wherein the socket cavity has an opening at the surface;

providing electrical connection to one or more socket contacts in the socket cavity; and providing at least one retainer configured to resiliently deflect from a first position;

wherein the apparatus is configured for insertion of a flexible, planar connector into the socket cavity;

wherein the apparatus is configured to have a first configuration in which the at least one retainer is at the first position, when the flexible, planar connector is not inserted into the socket cavity;

wherein the apparatus is configured to have automatically a second configuration in which the at least one retainer is resiliently deflected from the first position to a second position in response to the flexible, planar connector being inserted into the socket cavity; and wherein the apparatus is configured to have a third configuration different to the second configuration in which the at least one retainer is at or has partially returned to the first position from the second position, after the flexible, planar connector has been inserted into the socket cavity.

* * * * *